United States Patent [19]

Goessler

[11] Patent Number: 5,032,706

[45] Date of Patent: Jul. 16, 1991

[54] ELECTRIC RADIANT HEATER

[75] Inventor: Gerhard Goessler, Oberderdingen, Fed. Rep. of Germany

[73] Assignee: E.G.O. Elektro-Gerate Blanc u. Fischer, Fed. Rep. of Germany

[21] Appl. No.: 475,387

[22] Filed: Feb. 5, 1990

[30] Foreign Application Priority Data

Feb. 11, 1989 [DE] Fed. Rep. of Germany ..... 3904177

[51] Int. Cl.[5] ..... H05B 3/74

[52] U.S. Cl. ..... 219/464; 219/466

[58] Field of Search ..... 219/445, 458, 459, 460, 219/464, 465, 466, 468

[56] References Cited

U.S. PATENT DOCUMENTS

| | | | |
|---|---|---|---|
| 4,639,579 | 1/1987 | Brooks | 219/464 |
| 4,645,911 | 2/1987 | Husslein | 219/464 |
| 4,700,051 | 10/1987 | Goessler et al. | 219/464 |
| 4,789,772 | 12/1988 | McWilliams | 219/464 |

FOREIGN PATENT DOCUMENTS

| | | |
|---|---|---|
| 0164900 | 12/1985 | European Pat. Off. . |
| 0176027 | 4/1986 | European Pat. Off. . |
| 0206597 | 12/1986 | European Pat. Off. . |
| 0235895 | 9/1987 | European Pat. Off. . |
| 8525366 | 7/1986 | Fed. Rep. of Germany . |
| 3737475 | 5/1989 | Fed. Rep. of Germany . |
| 1273023 | 5/1972 | United Kingdom . |

*Primary Examiner*—Teresa J. Walberg

*Attorney, Agent, or Firm*—Eckert Seamans Cherin & Mellott

[57] ABSTRACT

A radiant heater with a light radiator constructed in the manner of a halogen radiator and a conventional dark radiator radiant heater is arranged in such a way that the dark radiator is arranged in a ring zone surrounding the circular light radiator. The central zone below the light radiator remains unheated. The dark radiator is positioned on an inner shoulder of the rim made from stronger insulating material and which consequently forms a ring with a L-shaped cross-section, which rests on a insulating layer.

9 Claims, 1 Drawing Sheet

ELECTRIC RADIANT HEATER

The invention relates to an electric radiant heater or element, particularly for heating glass-like plates, such as glass ceramic plates.

BACKGROUND OF THE INVENTION

British Patent 1 273 023 discloses an electric radiant heater, whose heating means has a heating resistor operated with a very high glow temperature, which is encapsulated in the manner of a halogen radiator in a quartz glass tube, which is curved in the manner of a circular arc. This light radiator is used for heating a glass ceramic plate.

U.S. Pat. No. 4,700,051 discloses the use of both light and dark radiators within a radiant heater. Preferably the dark radiator is always connected upstream of the light radiator and the dark radiator damps the high starting current of the light radiator. Arrangements are provided in which outside substantially parallel, rod-like light radiators, dark radiators are provided so as to externally surround the same. German Utility model 8525 366 also describes such an arrangement.

However, according to U.S. Pat. No. 4,700,051 circular light radiators always pass round in the outer marginal zone, so as to also optically limit or define the heating zone on the glass ceramic plate, because the latter is partly transparent at least in the case of the strong radiating action of the light radiator.

Despite their relatively high price, bent light radiators were developed in order to make it possible in a single passage round the outer area of the radiant heater to provide the total light radiator power leaving the central zone for the more surface acting dark radiators. It has been found that the glow pattern and other use characteristics, together with the ease of manufacture are not ideal.

SUMMARY OF THE INVENTION

The problem of the invention is therefore to so further develop a radiant heater with light and dark radiators, that it has a good glow pattern, improved use characteristics and easier manufacture. This problem is solved by claim 1.

The invention takes the apparently nonsensical proposal of not providing the circularly or multiangularly bent light radiator in the marginal area, but instead allowing it to surround a largely unheated central zone, whilst the dark radiator passes round in the outer area. This is not only in contradiction to the development tendency but also appears to remove or cast doubts on the advantage of the bent light radiator, namely that of optically defining the cooking or heating point.

However, it has surprisingly been found that the opposite is the case. It is to be assumed that a glass ceramic plate is always seen under an angle from the side. In this case a light radiator passing round directly in the outer marginal area would be covered by the raised rim on the side facing the viewer, because every effort is made to place the larger diameter light radiator relatively deeply in the shell-like insulating support, so as to obtain an adequate spacing from the heated plate and optionally an interposed temperature regulator. The observer then generally sees the light radiator only as a semicircle. However, the viewer sees the centrally located dark radiator brightly illuminated, which has an optically unattractive effect. Due to its greater thermal inertia the radiation of the dark radiator occurs later and does not extend sufficiently far into the visible range to have significance compared with the light radiator. However, this is not the case in the proposed arrangement, where the light radiator is sufficiently removed from the rim that, even under an oblique angle, the observer can still completely see the ring, whilst the rim covers the illuminated dark radiators in front of the same. However, in the rear region the light radiator is positioned in front of the dark radiators and irradiates over the same, so that in a visible form only the central zone free from all radiators is illuminated, which has an attractive appearance. If the user makes use of a pot which is smaller than the cooking point, then as a result of the positioning of the light radiator further inwards, the risk of glare is reduced.

Considerable advantages also occur from the use standpoint, because the light radiator, whose shortwave radiation increasingly directly penetrates the glass ceramic plate, so that at this point a contact between the cooking vessel and the heated plate is not so important, is positioned in the area in which a conventionally somewhat concave pot has a certain distance from the plate, whilst the dark radiators, whose power is transmitted to a greater extent by contact with the heated plate, are located in the area in which the pot stands with its outer rim. The radiation of the light radiator, which is at a certain distance from the plate, penetrates the latter in a relatively broad band which, on the one hand passes over the dark radiators and on the other enters the central zone. It is also advantageous that there is no heating of the central zone, because the light radiator radiation is in any case concentrated at this point.

The manufacturing advantage is obtained that there is no need to install dark radiators in the interior of the arcuate, circular or annular light radiator. They would also have to have a supply lead, which would have to pass under the light radiator and therefore under the insulation.

It is also advantageous that the ring area in which the dark radiator is located is immediately adjacent to the edge of the radiant heater, which projects up to the heated plate. Thus, this area can be constructed integrally with the edge as a ring and the dark radiators can be reliably fixed, e.g. by partial embedding to the preferably mechanically stronger insulating material from which the edge and also the dark radiator ring zone are formed. Other fixing methods can be particularly readily carried out in this area and in particular on a mechanically stronger insulator, e.g. containing a fibrous insulating material.

The complete inner area, in which are located the light radiator and the central zone, can be positioned in the interior of said ring, so that an insulating layer located below the marginal component there forms the insulating carrier surface. It can be recessed in circular form in the vicinity of the light radiator, so that the latter, which normally has a larger diameter than the dark radiators is aligned therewith by its upper edge, so as to ensure an identical spacing from the temperature sensor. This has the advantage of being able to use an insulating material in the central area, which has a very high thermal insulating capacity and also a high thermal stability, e.g. a pressed loose material based on a pyrogenic silicic acid aerogel. However, this material does not have a significant mechanical strength and would hardly allow fixing by embedding. However, its surface is adequately firm and stable in the light radiator and central area.

BRIEF DESCRIPTION OF THE DRAWINGS

These and further features of preferred developments of the invention can be gathered from the claims, description and drawings. The individual features can be realized singly or in the form of subcombinations in an embodiment of the invention and in other fields and constitute advantageous, independently protectible constructions for which protection is hereby claimed. The invention is described in greater detail hereinafter relative to the drawings, wherein show:

DETAILED DESCRIPTION OF THE PREFERRED EMBODIMENTS

Figure 1:
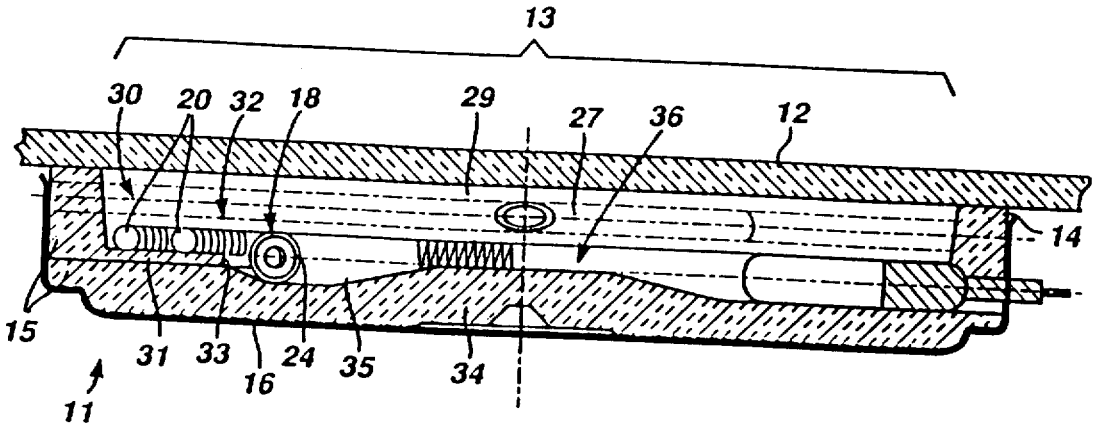
FIG. 1 a vertical section through a radiant heater positioned below a glass ceramic plate.

The drawings show a radiant heater 11 positioned below a glass ceramic plate 12 and defines thereon a heating or cooking point 13. An edge or rim 14 of an insulating support 15, which is located in a flat sheet metal carrier shell or tray 16, forms the outer boundary of the cooking point 13. The rim 14 of the radiant heater 11 is resiliently pressed by not shown means onto the underside of the glass ceramic plate 12.

The radiant heater 11 is heated by a light radiator 18 and a dark radiator 20. The light radiator contains in a quartz glass tube a high temperature-resistant heating resistor 21, e.g. made from tungsten, which passes from one light radiator connection end 22 to the other and is supported between the same by spacers 23. In the represented embodiment, for manufacturing grounds the quartz glass tube 24 is multiangular, e.g. bent in the form of an octagon to form an almost complete circle. Its two connections or terminals 22 pass in closely juxtaposed parallel form out of the radiant heater through rim 14 and are provided there with line terminals. The glow temperature is above 1500 K. and is preferably approximately 2300 K.

The glow temperature of the dark radiator 20 is well below this value and is preferably below 1500 K. It comprises a standard helically bent open wire made from resistance material which, due to its lower glow temperature, does not require an inert gas atmosphere in the same way as the light radiator. The dark radiator is constructed in the form of a double ring, whose connections 25 on the same side of the double arc extend to the inner and outer turn, whilst on the other side the two turns are interconnected by an arc 26. A connecting piece 38 for the dark radiator connections 25 is inserted in the edge of the carrier tray 15.

A rod-like temperature sensor 27 of a temperature switch 28 projects diametically over the circular radiant heater and is guided on both sides in the edge 14. The top or head of the temperature switch 28 is located outside the remaining radiant heater boundary. It normally contains two temperature switches, whereof one is used for limiting the temperature and the other as a signal contact for indicating the hot state of the cooking point. As can be gathered from FIG. 1, the temperature sensor 27, which can optionally have an insulating outer tube, projects through the dish-shaped inner area 29 of the radiant heater, whilst being spaced from the underside of the glass ceramic plate 12 and the radiators 18,20. The light and dark radiators are connected to one another and to the temperature limiter contact of the temperature switch 28 electrically and in series.

In a ring area 30, the dark radiator 20 is located on an inner flange-like portion 31 directed inwards from rim 14 and therefore together with the latter forms a one-piece, annular component 32 with a L-shaped cross-section. It is made from an insulating material with a good mechanical strength, which contains or comprises a relatively high proportion of heat-resistant fibres, e.g. $Al_2O_3$. It can be produced wet in a vacuum suction process. In the wet state the heating coils of dark radiator 20 are partly pressed into the surface and after drying or complete hardening are well fixed therein, although most of the same and in particular almost the entire inner region of the heating coils remains free and can therefore adequately radiate or emit. The outer turn of the dark radiator 20 can be tightly connected to the inside of rim 14 and portion 31 terminates with a ring inner edge 33 with a non-excessive spacing from the light radiator 18. The central axis of the latter is positioned somewhat lower than the dark radiator, so that, despite its larger diameter its top is aligned with the top of the dark radiator. For this purpose an insulating layer 34 belonging to the insulating support 15 and on which the component 32 rests in the marginal area, is lowered in the vicinity of the light radiator, so that it forms there a circular shallow ending channel 35, which rises again towards the centre.

No separate heating means is provided in the central zone 36 located within the circular light radiator 18, the insulating layer 34 forming the surface here. Insulating layer 34 is formed from a pyrogenic silicic acid aerogel, which has excellent thermal insulating characteristics and a high thermal stability and, after relatively loose compression, has a surface which, because it is exposed to no significant stresses, is adequately strong for use. Thus, the insulating support is constructed in an advantageous manner from the manufacturing and functional standpoints, because the use of two insulating materials with different characteristics is limited to the areas in which the characteristics have an optimum effect. In the represented embodiment the light radiator, although it is positioned so low that the temperature sensor can pass through with a good spacing therefrom and from the heated plate 12, is almost completely seen as a ring, even in the case of a viewing angle of approximately 30°, whereas the dark radiator cannot be seen in the front area. It is particularly advantageous that the dark radiator ring zone 30 has a diameter between 10 and 20 and preferably 15% of the total diameter of the cooking point 13, whilst the diameter of the light radiator 18 is between 15 and 70 and preferably 60% of the cooking point diameter.

This in particular leads to a very low or shallow radiant heater, which still has a good insulation and which is very well fixed. The light radiator 18 can rest on insulating layer 34 in the vicinity of channel 35 and is also guided in the area in which it passes through the rim 14 and corresponding openings of the carrier tray 16. The arrangement with two parallel, juxtaposed light radiator connections 22 passing out is preferred, because it permits a dark radiator ring zone 30 largely surrounding the light radiator 18. It would also be possible to arrange several dark radiators in the dark radiator ring zone and to create multi-circle radiant heaters, in which several light and/or dark radiators are arranged in circular or juxtaposed form and can be switched in either individually or together, so that a cooking point of varying size and/or configuration is obtained. A further advantage is the favourable positioning of all the connection ends in the marginal zone.

In the case of another dark radiator fixing mode, it would also be possible to obviate portion 31 and to fit the dark radiators directly to the insulating layer 34. Over a certain height the rim could also be made in this case from the insulating material of insulating layer 34, which has better thermal insulating characteristics than the fibrous material of the rim.

I claim:

1. An electric radiant heater for heating plates, such as glass ceramic plates, comprising:

insulating support means;

at least one electric, visible light radiator means, said radiator means being arranged in a light radiator zone and having a heating resistor capable of assuming temperatures of more than 1500° K., said light radiator means surrounding a central zone of the radiant heater;

at least one relatively darker infra-red radiator means having a heating resistor operating at a temperature of less than 1500° K. and externally surrounding the light radiator means;

wherein the insulating support means comprises an insulating layer made of a first insulating material having a relatively low thermal conductivity and a ring made of a second insulating material which is relatively mechanically stronger but has relatively higher thermal conductivity than the insulating layer, the ring being disposed on the insulating layer and having an L-shaped cross-section, one side of said ring constituting an outer rim rising up to the heated plate and an opposite side of said ring constituting a ring zone with a shoulder-like surface, wherein said darker infrared radiator means is fastened to said shoulder-like surface, said ring surrounding the light radiator zone and the central zone, in which zones the insulating layer provides an upper surface of the insulating support means.

2. Radiant heater according to claim 1, wherein the central zone is unheated.

3. Radiant heater according to claim 1 wherein at least one of the radiator means has a substantially circular basic shape.

4. Radiant heater according to claim 1, wherein the central zone of the insulating layer is raised compared with the vicinity of the light radiator means.

5. Radiant heater according to claim 1, wherein portions of the light radiator means and darker radiator means closest to the heated plate are located substantially in one plane.

6. Radiant heater according to claim 5, wherein the light radiator means is located in the vicinity of a depression of the insulating layer.

7. Radiant heater according to claim 1, wherein the ring is made from insulating material containing fibers.

8. Radiant heater according to claim 1, wherein a rod-like temperature sensor traverses the space between the radiator means and plate in spaced manner with respect to both of these and passes through a rim of insulating support means.

9. Radiant heater according to claim 1, wherein the ring zone is shaped like a circular arc open for a connection of the light radiator means and in which the darker radiator is guided as a double loop, having its connections in closely juxtaposed form on one side of the light radiator means connection.

* * * * *

UNITED STATES PATENT AND TRADEMARK OFFICE

CERTIFICATE OF CORRECTION

PATENT NO. : 5,032,706

DATED : July 16, 1991

INVENTOR(S) : Gerhard Goessler

Figure 2:
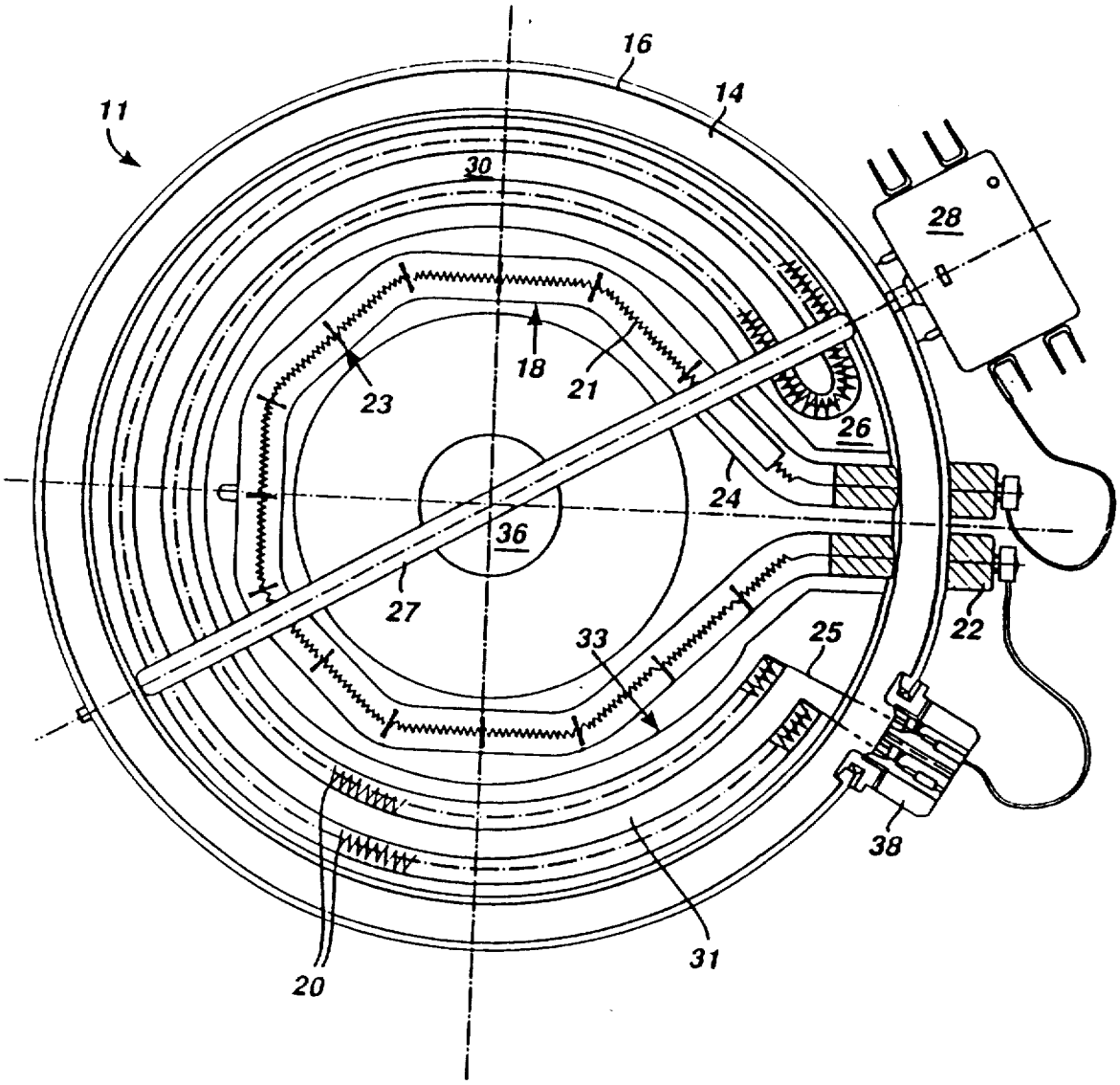
FIG. 2 a plan view of the radiant heater (without glass ceramic plate).

It is certified that error appears in the above-identified patent and that said Letters Patent is hereby corrected as shown below:

Insert figures 1 and 2 as part of Letters Patent as shown on the attached sheet.

Signed and Sealed this

Sixteenth Day of March, 1993

*Attest:*

STEPHEN G. KUNIN

*Attesting Officer*

*Acting Commissioner of Patents and Trademarks*